US005306169A

United States Patent [19]

Fukushima et al.

[11] Patent Number: 5,306,169

[45] Date of Patent: Apr. 26, 1994

[54] ELECTRICAL CONNECTOR FOR CONNECTING PRINTED CIRCUIT BOARDS

[75] Inventors: Minoru Fukushima, Yokohama; Shinichi Tadokoro, Fujisawa; Masahiro Henmi, Yokohama, all of Japan

[73] Assignee: Molex Incorporated, Lisle, Ill.

[21] Appl. No.: 101,605

[22] Filed: Aug. 3, 1993

[30] Foreign Application Priority Data

Nov. 19, 1992 [JP] Japan ..... 4-085830[U]

[51] Int. Cl.[5] ..... H01R 13/629

[52] U.S. Cl. ..... 439/248

[58] Field of Search ..... 439/246–252

[56] References Cited

U.S. PATENT DOCUMENTS

| | | | |
|---|---|---|---|
| 4,722,691 | 2/1988 | Gladd et al. | 439/79 |
| 4,738,631 | 4/1988 | Takahashi et al. | 439/248 |
| 4,810,215 | 3/1989 | Kaneko | 439/845 |
| 4,998,889 | 3/1991 | Moly | 439/248 |
| 5,057,027 | 10/1991 | Yamada et al. | 439/83 |
| 5,112,235 | 5/1992 | Enomoto et al. | 439/83 |
| 5,122,066 | 6/1992 | Plossmer | 439/78 |
| 5,201,663 | 4/1993 | Kikuchi et al. | 439/83 |
| 5,259,779 | 11/1993 | Ooya et al. | 439/247 |

FOREIGN PATENT DOCUMENTS 2106882 4/1990 Japan .

*Primary Examiner*—Gary F. Paumen

*Attorney, Agent, or Firm*—Stephen Z. Weiss

[57] ABSTRACT

An electrical connector is disclosed with a contact housing for receiving terminal mating sections of a plurality of terminals and a tail housing, separate from the contact housing, for receiving solder tail sections of the terminals. A flexible connecting section is formed between the terminal mating and solder tail sections of each terminal. A protective bar extends from the terminal mating section toward the tail housing. An arm extends from the protective bar which is inserted into a mounting recess formed in the tail housing without contacting any surfaces of the mounting recess under normal conditions.

4 Claims, 6 Drawing Sheets

ELECTRICAL CONNECTOR FOR CONNECTING PRINTED CIRCUIT BOARDS

FIELD OF THE INVENTION

This invention generally relates to the art of electrical connectors and, more particularly, to an electrical connector for connecting printed circuit boards.

BACKGROUND OF THE INVENTION

As is well known, electrical connectors are commonly used for connecting the conductors on one printed circuit board to those on another printed circuit board. Due to the fact that there is the possibility of the printed circuit boards being offset in position to each other relative to their predetermined positions (such state is hereinafter referred to as "pitch-shift"), the prior electrical connectors have been constructed to include any means for accommodating such pitch-shift.

The electrical connectors in the prior art include terminals each having a contact and a tail connected to each other by means of a flexible joint. This flexible joint usually has less rigidity for reducing the load thereto required for flexing to accommodate the pitch-shift. To avoid damage to the flexible joint when it is flexed and to make sure of the proper positioning of the tail when the connector is mounted to the printed circuit boards.

A first type of the prior art connector, discussed in U.S. Pat. No. 5,112,235, is constructed in such a manner that the contact and the tail of the terminal are connected together by means of a flexible joint. The terminal contact is mounted in the contact housing. The tail is fixed to a tail housing part. The contact housing part is provided with the peg. The flexible joint accommodates for the pitch-shift and the peg protects the flexible joint. The tail housing part makes sure of the proper positioning of the tail of the terminal. After assembly of this electrical connector, the connection between the contact housing and the tail housing parts is broken.

A second type of prior art connector disclosed in U.S. patent application Ser. No. 991,792 filed Dec. 17 1992, comprises an inner and outer housing which receive the terminal contact and the terminal tail, respectively. Fitting nails are used to prevent the contact housing from lifting up. The position of the terminal is achieved by the tail housing. After assembly, a connection between both housings is broken.

Finally, a third type of prior art connector disclosed in U.S. patent application Ser. No. 73,813 filed Jun. 8, 1993, comprises an inner and outer housing which receives the terminal contact and the terminal tail, respectively. Both housings are connected to each other with a flexible joint to accommodate the pitch-shift and to prevent the upward lift of the contact housing. The proper position of the tail is assured by the tail housing.

Although the prior art connectors as stated above provide excellent results, they still have some disadvantages. In the event that two printed circuit boards to be electrically connected are considerably offset in position from one another, a relatively higher load may be placed on the flexible joint to accommodate for this greater pitch-shift. This is especially true for the third prior art connector types.

A large amount of unused space on the printed circuit boards is needed to use the first and second type of prior art connectors. Also in some connectors additional parts may be required or may have to be disposed of as is the case with the third type of prior art connector, thereby increasing the number of process steps and/or assembly steps.

SUMMARY OF THE INVENTION

In view of the above, an object of the present invention is to provide a new and improved electrical connector which accommodates for pitch-shift with a two part connector housing having a terminal with a flexible joint where the load to the flexible joint required for flexing to accommodate such pitch-shift is reduced, where unused space on the printed circuit board is eliminated and no additional parts are required.

In order to achieve the above objects, the present invention provides a two part floating connector adapted to be mounted on the surface of a printed circuit board. The connector includes a contact housing part having a plurality of first terminal receiving cavities, a solder tail housing part adjacent to the contact housing part and having a plurality of second terminal receiving cavities in line with the first terminal receiving cavities, and a plurality of terminals. Each of the terminals have a terminal mating section, a solder tail section and a flexible connecting section. The terminal mating sections are held in the first terminal receiving cavities and the solder tail sections are held in the second terminal receiving cavities. The contact housing and solder tail housing parts are held together in a plane in a generally sliding relationship with one another by the terminals. A mounting recess in the solder tail housing part having a longitudinal axis which extends parallel to the plane of the generally sliding relationship. A protective bar extends from the terminal mating section toward the solder tail housing part and has an arm adapted to be slidably engaged in the mounting recess in a direction parallel to said longitudinal axis of said mounting recess. Any force placed upon the terminal mating section attempting to move the contact housing part out of the sliding plane will be met by an opposite force caused by the arm contacting an inner wall of the mounting recess thereby reducing stress on the terminal flexible connecting section.

In another embodiment of this invention, the sliding plane is parallel to the printed circuit board. Also the contact housing part may have rear walls adapted to contact rear end stopper projections formed on the solder tail housing part after a predetermined relative sliding movement occurs between the housing parts so that the arm part will not be able to slide out of the mounting recess.

BRIEF DESCRIPTION OF THE DRAWINGS

The invention, together with its objects and the advantages thereof, may be best understood by reference to the following description taken in conjunction with the accompanying drawings in which.

DETAILED DESCRIPTION OF THE PREFERRED EMBODIMENT

Figure 1:
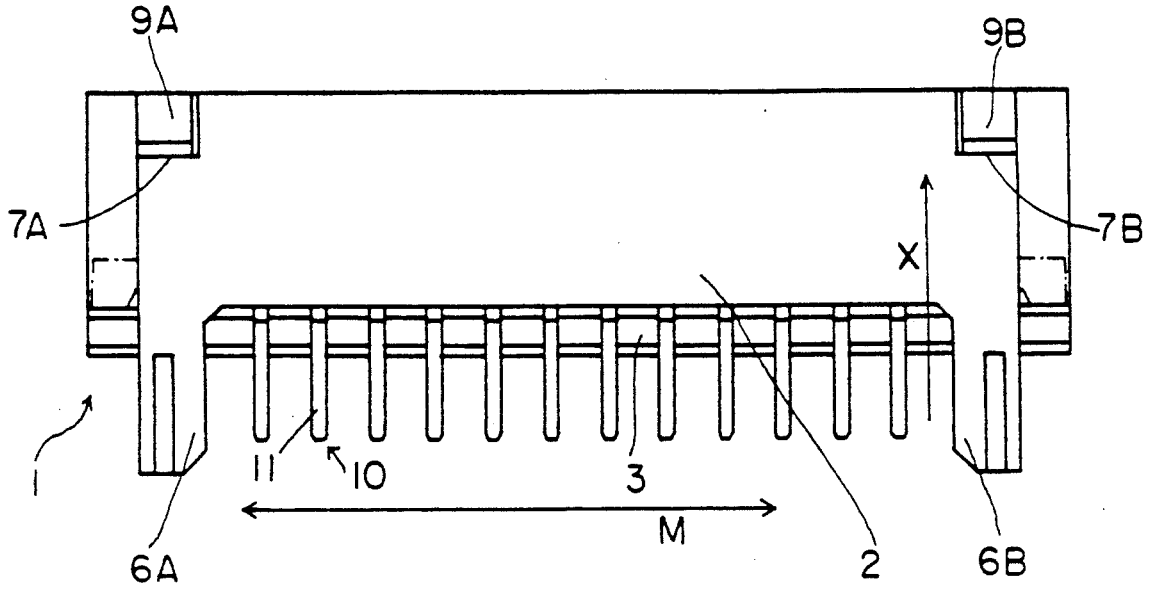
FIG. 1 is a top view showing an electrical connector according to the present invention.
Figure 2:
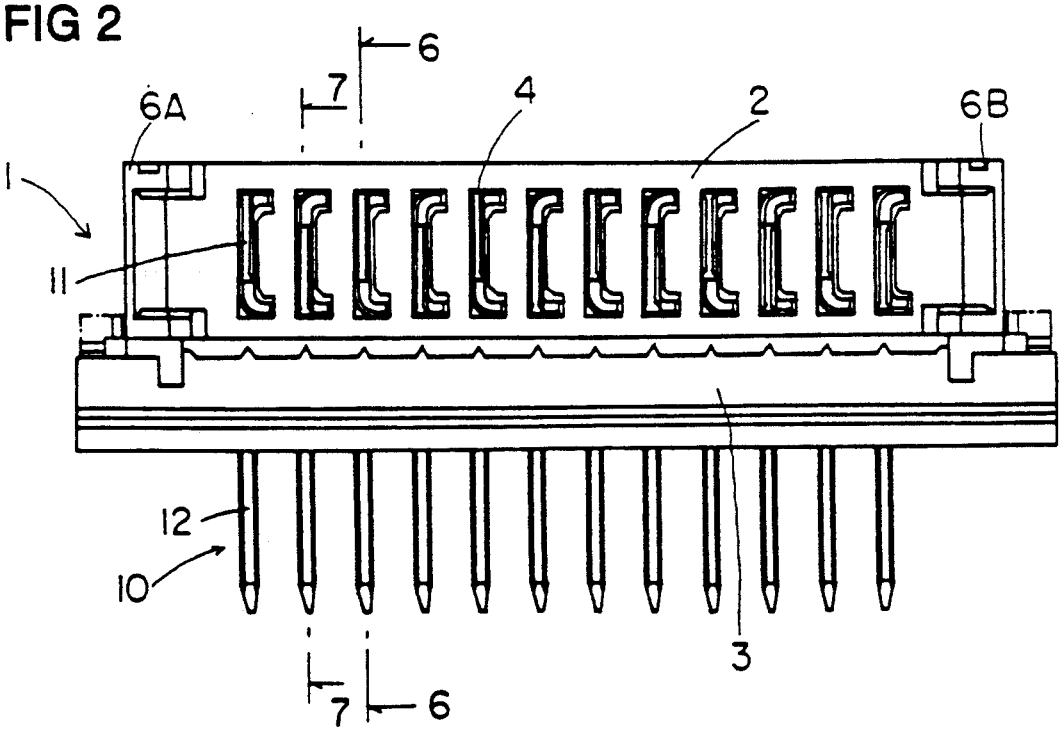
FIG. 2 is a front elevational view of the electrical connector as shown in FIG. 1.
Figure 3:
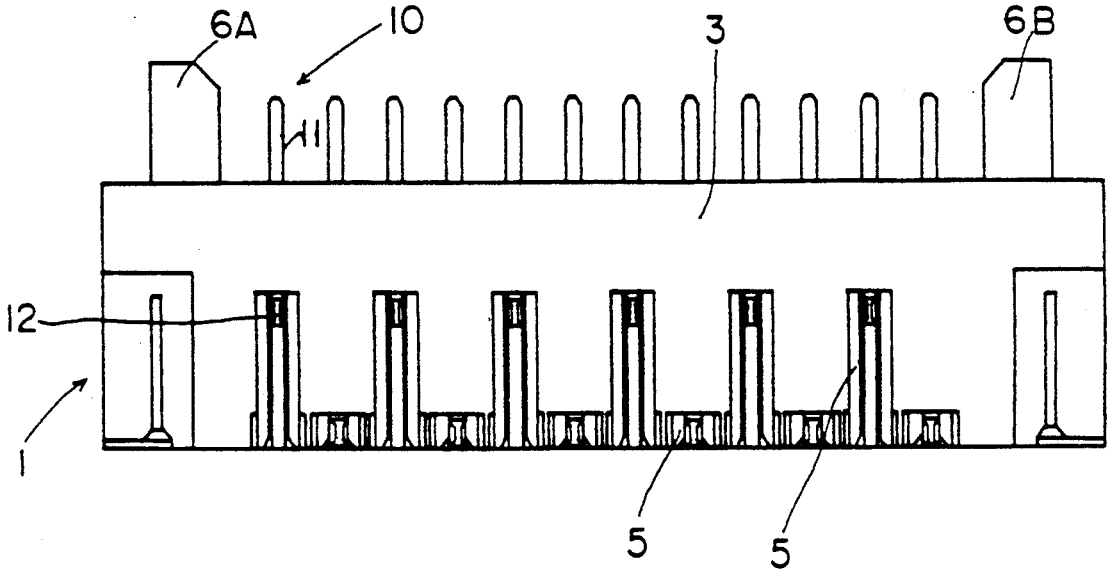
FIG. 3 is a bottom view of the electrical connector as shown in FIG. 1.
Figure 4:
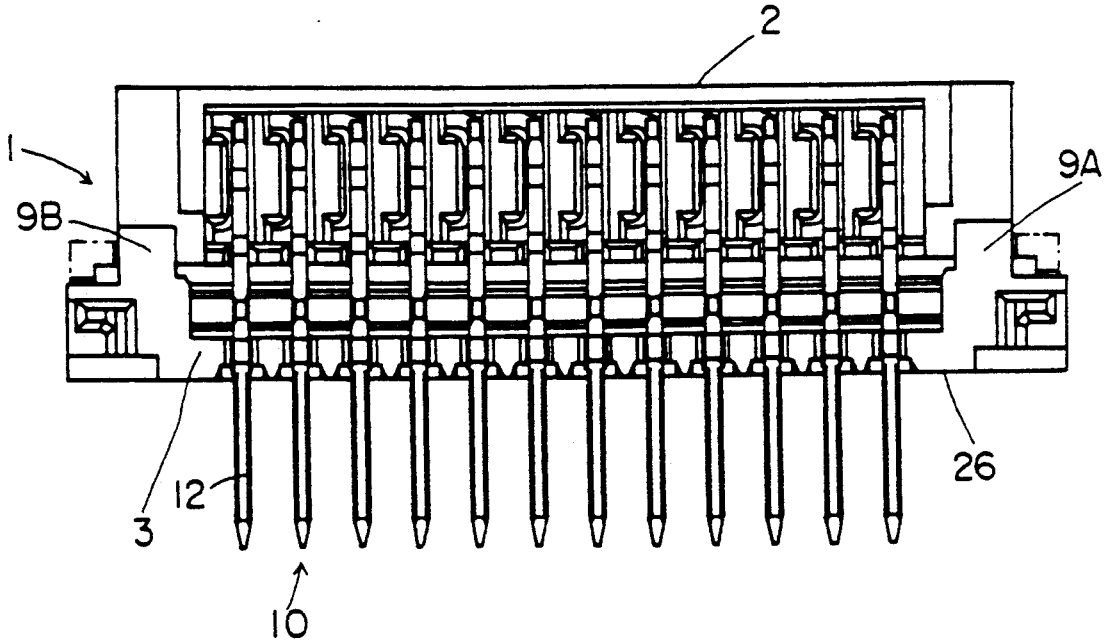
FIG. 4 is a rear elevational view of the electrical connector as shown in FIG. 1.
Figure 5:
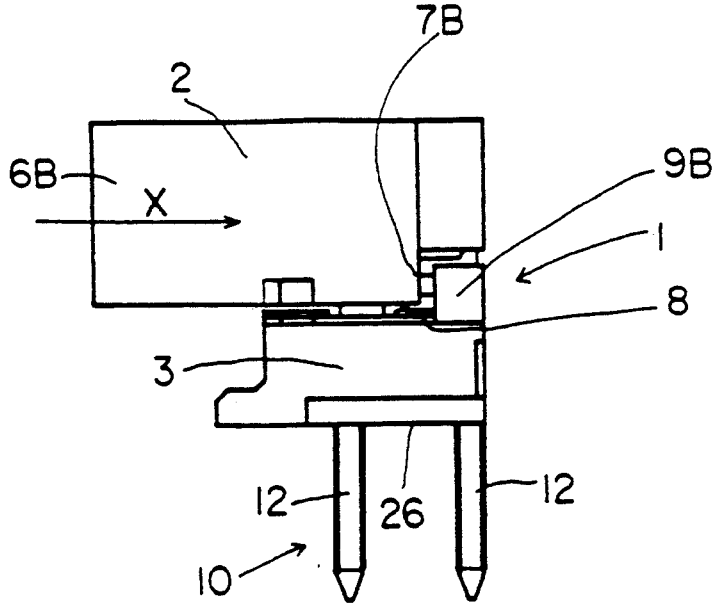
FIG. 5 is a side view of the electrical connector as viewed from the right-hand side thereof in FIG. 1.

Referring to FIGS. 1 to 7 in greater detail, an electrical connector 1 comprises a contact housing 2 and a tail housing 3 which is independent to said contact housing 2. As can be seen from FIGS. 5, 6 and 7, the contact housing 2 is positioned adjacent an upper surface 8 of the tail housing 3 defining a plane of relative sliding between the housings. The contact housing 2 has a plurality of first terminal receiving cavities 4 formed therein for receiving the terminal mating section 11 of the terminals and the tail housing 3 has a plurality of second terminal receiving cavities 5 formed therein for receiving the solder tail section 12 of the terminals.

As can be seen in FIG. 1, the contact housing 2 has wings 6A and 6B integrally formed therewith and extending from both ends thereof towards the front side. In addition, the contact housing 2 has rear end walls 7A and 7B at the rear side thereof, which are arranged to abut against rear stopper projections 9A and 9B integrally formed on the upper surface 8 of the tail housing 3 at both rear ends thereof.

Figure 8:
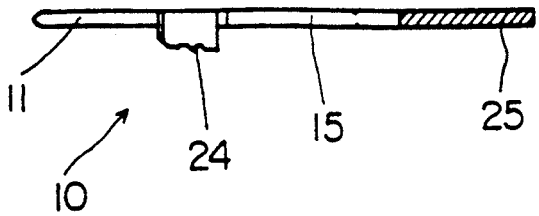
FIG. 8 is a plan view showing the terminal with a carrier.
Figure 9:
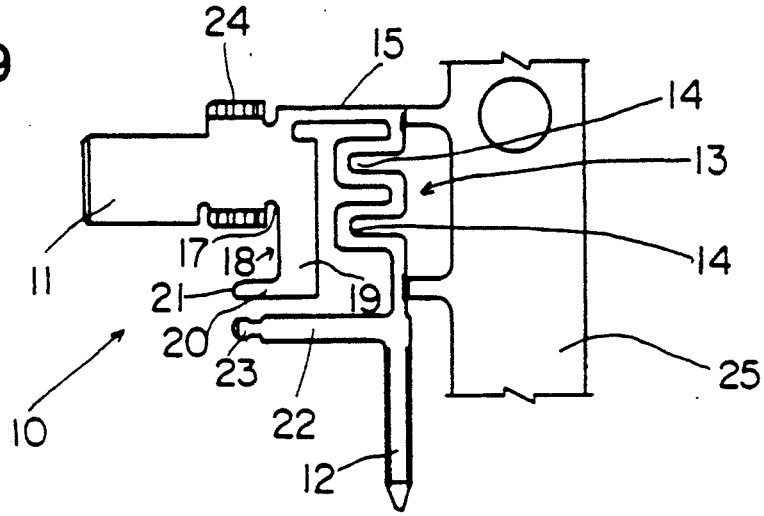
FIG. 9 is a side view of the terminal with the carrier as viewed from the right-hand side thereof.
Figure 10:
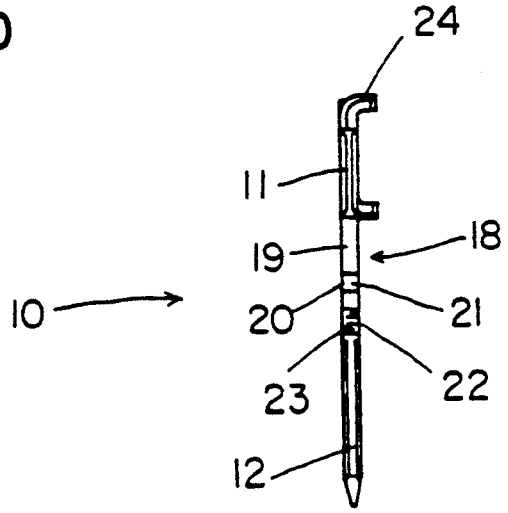
FIG. 10 is a front elevational view of the terminal with the carrier.

Referring to FIGS. 8, 9 and 10 each representing a terminal 10 to be mounted to the electrical connector 1, the terminal 10 has a terminal mating section 11 and a solder tail section 12. The terminal mating section 11 is formed as a male blade in this embodiment. The terminal mating sections 11 and the solder tail sections 12 are joined together by means of flexible connecting sections 13. This flexible connecting section 13 consists of two "U" shaped portions 14 arranged side by side and connected in series with a linear portion 15 interposed between one of the "U" shaped portions 14 (one positioned at the upper side as viewed in FIG. 9) and the terminal mating section 11.

In addition a protective bar 18 is provided extending downwardly from rear portion 17 located between the terminal mating section 11 and the flexible connecting section 13. This protective bar 18 includes a vertical portion 19 extending vertically as viewed in FIG. 9 and a horizontal arm 20 integrally formed therewith and extending horizontally which is parallel with the terminal mating section 11. The horizontal arm 20 has a tip 21 at one end thereof.

A pressure fit piece 22 is formed near the solder tail section 12 which is parallel with the linear portion 15 of the flexible connecting section 13. The pressure fit piece 22 sufficiently extends to align a tip 23 thereof with the tip 21 of the horizontal arm 20 of the protective bar 18.

A reference numeral 24 represents pressure fit portions for the terminal mating section 11 formed at upper and lower sides of the main body section thereof and a reference numeral 25 represents a carrier used to manufacture the terminal 10.

In order to mount the terminals 10 as shown in FIGS. 8-10 to said electrical connector i, especially into the contact housing 2 and the tail housing 3, the terminal mating section 11 is put into the cavity 4 of the contact housing 2 and the solder tail section 12 is put into the tail housing 3 with the tail downwardly extending through a bottom surface 26 thereof. Then the flexible connecting section 13 is positioned at a rear space 27 of the contact housing 2.

It is to be noted here that the tip 23 of the pressure fit piece 22 is fit into a groove 28 formed in the front wall of the tail housing 3. On the other hand, the tip 21 of the horizontal arm 20 of the protective bar 18 is inserted into a mounting recess 30 having a longitudinal axis "A" formed in the front wall of the tail housing 3 without contacting the bottom surface 31 nor the peripheral surface 32 of said mounting recess 30 under a normal condition where no load is applied to the entire terminal 10.

Figure 6:
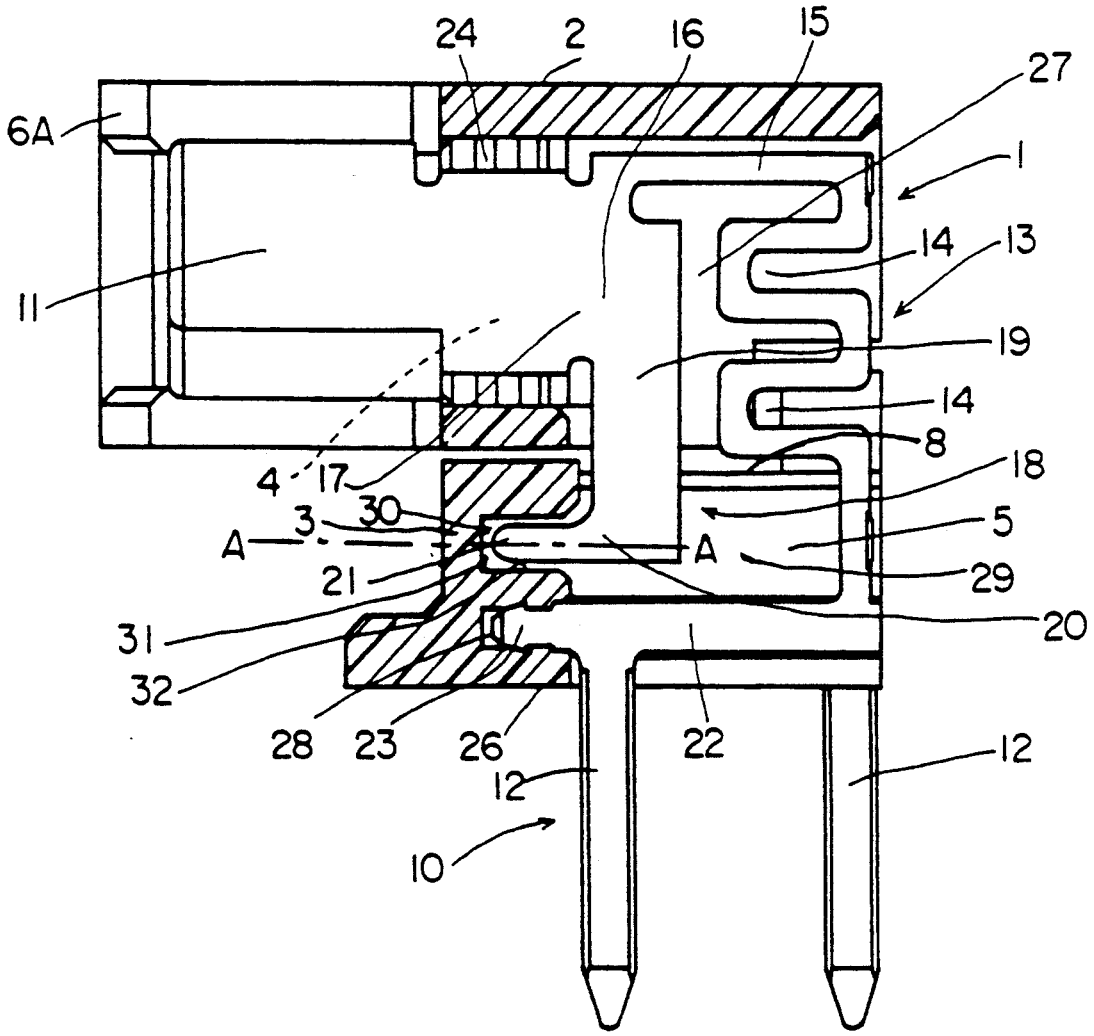
FIG. 6 is a sectional view taken along line 6—6 of FIG. 2.
Figure 7:
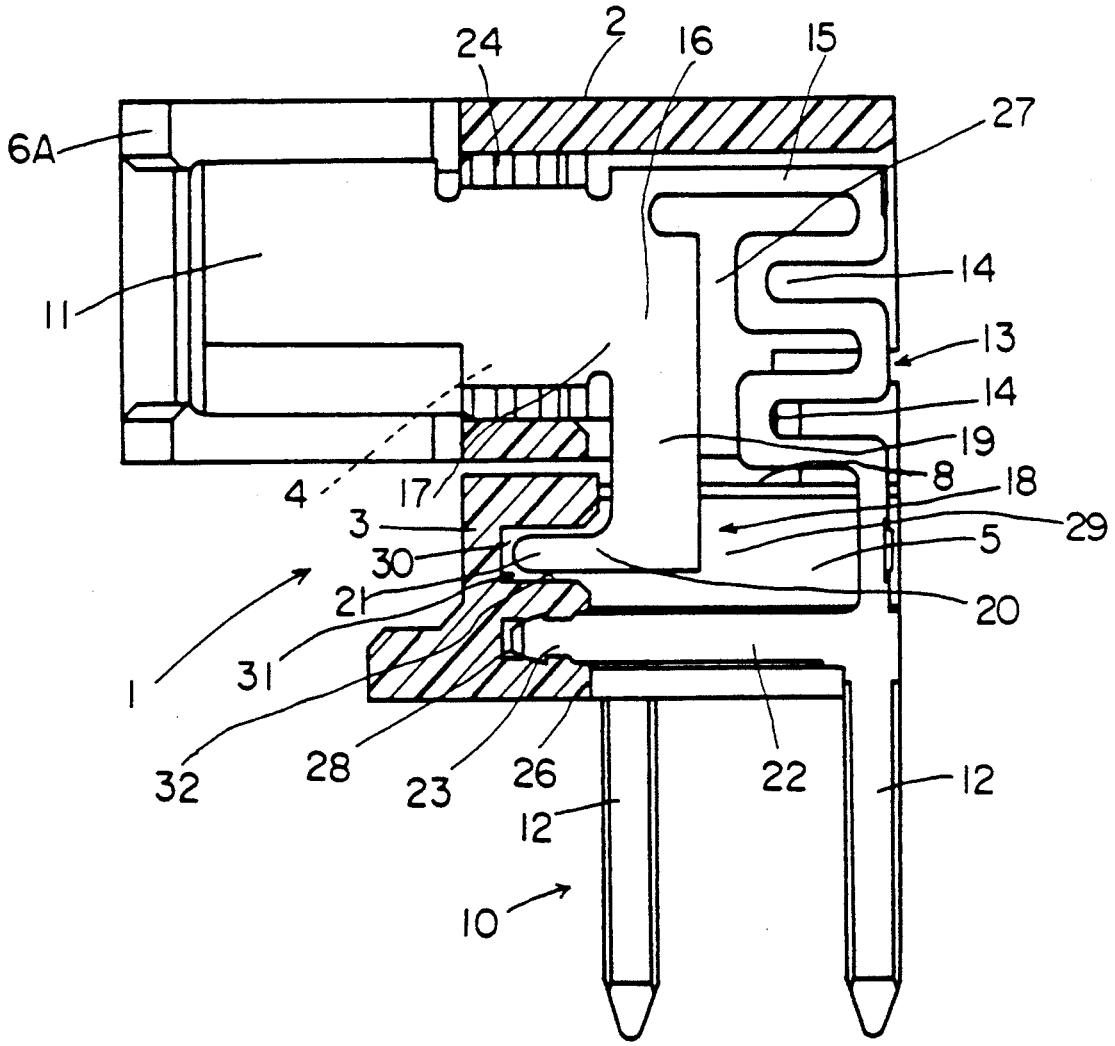
FIG. 7 is a sectional view taken along line 7—7 of FIG. 2

The electrical connector 1 is constructed in such a manner that the adjacent terminals 10 are mounted with their adjacent solder tail sections 12 alternatively positioned at front and rear sides of the tail housing 3. FIG. 6 shows the terminal 10 with its solder tail portion 12 positioned at the front side of the tail housing 3 and FIG. 7 shows the adjacent terminal 10 with its solder tail portion 12 positioned at the rear side of the tail housing 3.

Figure 11:
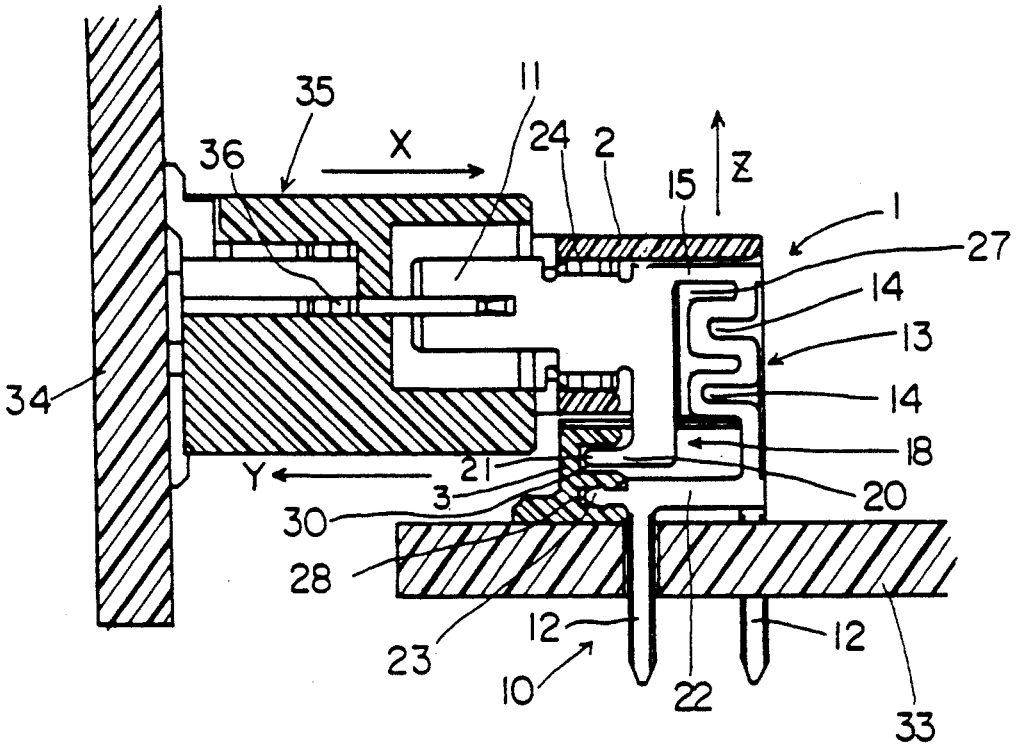
FIG. 11 is a sectional view showing a mated connection between the electrical connector according to the present invention mounted on one printed circuit board and another electrical connector mounted on another printed circuit board.

The operation of the electrical connector according to the present invention will be described with reference to FIG. 11. The electrical connector 1 is mounted on one printed circuit board 33 and another electrical connector 35 is mounted on the other printed circuit board 34. Both electrical connectors 1 and 35 are shown connected to each other.

If both printed circuit boards 33 and 34, and hence both electrical connectors 1 and 35, are offset in relation to each other from their predetermined positions, the flexible connecting section 13 accommodates this pitch-shift, with the result that a normal mated connection can be achieved between both electrical connectors. It is apparent that the load to the terminal 10 required to accommodate the pitch-shift can be kept low because the contact housing 2 and the tail housing 3 are separated and only the flexible connecting section 13 is displaced to accommodate the pitch-shift. Furthermore, the proper position of the solder tail portion 12 is assured due to the fact that the tip 23 of the pressure fit piece 22 is secured and held in the groove 28.

When electrical connector 35 is mated to electrical connector 1, a force is applied to the terminal mating section 11 of the terminal 10 in the mating direction, as indicated by arrow "X". Under certain conditions the flexible connecting section 13 tends to be displaced in a vertical plane upwardly as indicated by an arrow "Z", downwardly, or rotationally. This displacement in the vertical plane, however, is inhibited by the tip 21 of the horizontal arm 20 of the protective bar 18 contacting the peripheral surface 32 of the mounting recess 30. The same is true for the case where the electrical connector 35 is disengaged from the present electrical connector 1. At such time, a force is applied to the terminal mating section 11 of the terminal 10 in a direction "Y", where the flexible connecting section 13 tends to be displaced also in the vertical plane. However, the tip 21 of the horizontal arm 20 abuts against the end wall surface 31 of the mounting recess 30, thereby inhibiting the displacement in the "Y" direction. In other words, the cooperation of the protective bar 18 and the mounting recess 30 effectively provides the protection for the flexible connecting section 13 and will allow for relative movement between the contact and tail houosing parts in a direction generally parallel to the longitudinal axis "A" of tahe mounting recess 30. It will be apparent that because both the protective bar 18 and the mounting recess 30 are included and formed within the contact and tail housings 2 and 3, rather than the conventional means such as a peg and the like which are externally formed and externally projecting, there is no unused space existing on the printed circuit boards. Furthermore, because they are not the additional parts for the connector, there is no need for extra process steps for assembly of the connector.

In addition, it can be seen from FIG. 1 that when said electrical connector 35 is mated to the present electrical connector 1, both rear end walls 7A and 7B of the contact housing 2 of the connector 1 abut the rear end stopper projections 9A and 9B on the tail housing 3, respectively to inhibit the extreme rearward displacement of the contact housing 2. This also serves to protect the flexible joint 13 of the terminal 10. Further, the wings 6A and 6B formed on both ends of the contact housing 2 serve to constrain the electrical connector 35 against the lateral movement thereof in a direction "M" as indicated in FIG. 1.

Figure 12:
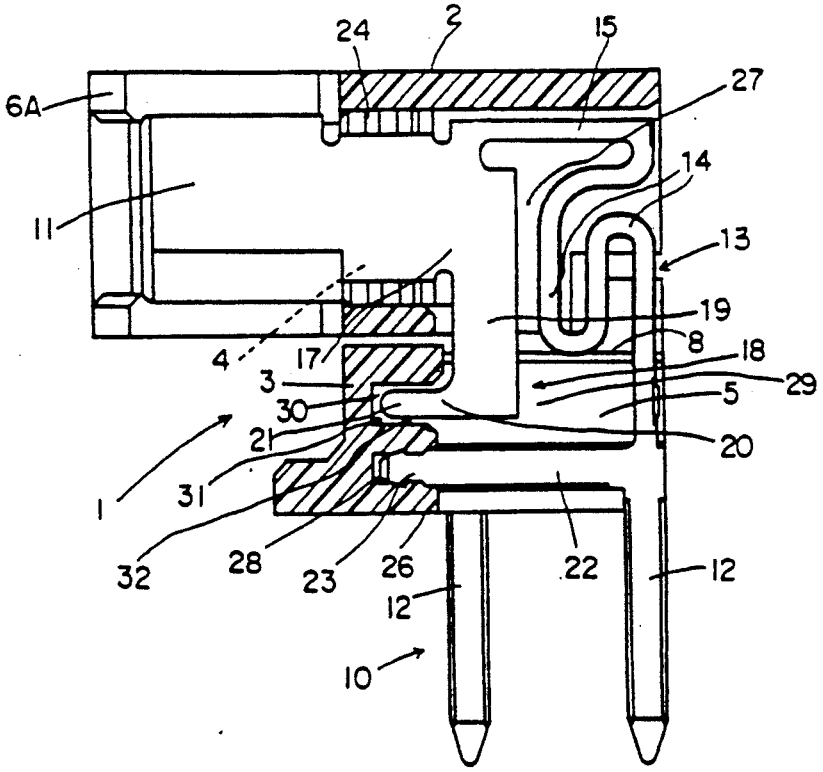
FIG. 12 is a sectional view similar to FIG. 7 with a terminal having a differently shaped flexible joint.

The electrical connector according to the present invention may be constructed in a different way without departing the scope of the present invention. For example, the flexible joint 13 may have a different shape such as shown in FIG. 12, rather than that described above.

It will be understood that the embodiments as stated above are to be considered as illustrative and not restrictive, and the invention is only limited by the claims appended below.

We claim:

1. A two part floating connector adapted to be mounted on the surface of a printed circuit board, said connector including, a contact housing part having a plurality of first terminal receiving cavities;

a solder tail housing part adjacent said contact housing part and having a plurality of second terminal receiving cavities in line with the first terminal receiving cavities;

a plurality of terminals, each terminal having a terminal mating section, a solder tail section and a flexible connecting section, said terminal mating sections held in said first terminal receiving cavities, said solder tail sections held in said second terminal receiving cavities, whereby the contact housing and solder tail housing parts are held together in a plane in a generally sliding relationship with one another by the terminals;

the improvement comprising:

a mounting recess in said solder tail housing part, said mounting recess having a longitudinal axis extending parallel to the plane of the generally sliding relationship, a protective bar extending from said terminal mating section toward said solder tail housing part, said protective bar having an arm adapted to be slidably engaged in the mounting recess in a direction parallel to said longitudinal axis of said mounting recess, whereby any force placed upon the terminal mating section attempting to move said contact housing part out of said sliding plane will be met by an opposite force cause by the arm contacting an inner wall of the mounting recess thereby reducing stress on the terminal flexible connecting section of the terminal.

2. A two part floating connector as set forth in claim 1, wherein said sliding plane is parallel to the printed circuit board.

3. A two part floating connector as set forth in claim 1, wherein said contact housing part has rear walls adapted to contact rear end stopper projections formed on said solder tail housing part after a predetermined relative sliding movement occurs between the housing parts so that the arm will not be able to slide out of the mounting recess.

4. A two part floating connector as set forth in claim 2, wherein said contact housing part has rear walls adapted to contact rear end stopper projections formed on said solder tail housing part after a predetermined relative sliding movement occurs between the housing parts so that the arm will not be able to slide out of the mounting recess.

* * * * *